United States Patent [19]

Leavens et al.

[11] 3,962,469

[45] June 8, 1976

[54] FRUIT TRAY PACKAGE

[75] Inventors: Roland B. Leavens; Mark G. McNair, both of Hood River, Oreg.

[73] Assignee: Diamond Fruit Growers, Inc., Hood River, Oreg.

[22] Filed: Feb. 22, 1974

[21] Appl. No.: 444,971

[52] U.S. Cl. ..... 426/108; 206/497; 206/499; 206/503; 206/521; 217/26.5; 426/119

[51] Int. Cl.[2] ..... B65B 23/00; B65B 25/04

[58] Field of Search ..... 426/106, 108, 119, 124, 426/392, 396; 217/26.5, 40, 28, 26, 27; 229/2.5; 206/497, 499, 503, 508, 516, 521

[56] References Cited

UNITED STATES PATENTS

| | | | |
|---|---|---|---|
| 1,316,304 | 9/1919 | Henderson | 217/27 |
| 2,106,921 | 2/1938 | Sykes | 217/27 |
| 2,539,514 | 1/1951 | Jenett | 206/516 |
| 2,571,340 | 10/1951 | Carson | 426/106 |
| 2,662,649 | 12/1953 | Gill et al. | 206/499 X |
| 2,893,550 | 7/1959 | Sandmeyer | 426/108 X |
| 3,040,923 | 6/1962 | Leitzel | 217/26.5 |
| 3,224,569 | 12/1965 | Leitzel | 229/2.5 |
| 3,262,786 | 7/1966 | Weiss | 426/119 |
| 3,298,511 | 1/1967 | Schertz | 206/499 |
| 3,450,542 | 6/1969 | Badran | 426/108 X |
| 3,740,238 | 6/1973 | Graham | 426/124 |
| 3,853,221 | 12/1974 | Boyd | 206/521 |

FOREIGN PATENTS OR APPLICATIONS

| | | | |
|---|---|---|---|
| 685,161 | 4/1964 | Canada | 426/119 |

*Primary Examiner*—Steven L. Weinstein
*Attorney, Agent, or Firm*—Klarquist, Sparkman, Campbell, Leigh, Hall & Whinston

[57] ABSTRACT

Fruit tray is covered with plastic film that is pressed by overlying tray into engagement with each fruit to prevent bouncing and rotation of the fruit.

4 Claims, 3 Drawing Figures

FRUIT TRAY PACKAGE

BACKGROUND OF THE INVENTION

Considerable effort has been devoted to packaging systems for fresh fruit such as apples and pears to prevent damage to the fruit during shipping. To this end trays of molded pulp have been designed in which pockets are formed for individual fruit specimens, the trays forming layers of fruit within a carton. However, in many instances the fruit within the carton is not held snugly during shipment and the vibration and other motion during transit will cause the fruit to jiggle and rotate during shipment so as to scuff the surface. This is particularly a problem with the tender skinned pears.

BRIEF DESCRIPTION OF THE INVENTION

It is a principal object of the present invention to provide a new packaging system for fresh fruits and other round objects that will minimize movement of the fruit or object during shipment so as to minimize surface damage to the same.

In accordance with the present invention, a tray of fruit or the like having pockets therein for retaining the fruit in spaced, staggered rows is covered with a sheet of a flexible plastic or like material. The flexible sheet is secured to at least two opposite edges of the tray and is arranged in a partially slack condition such that when an overlying tray is stacked thereon the superposed tray will depress the plastic sheet onto each of the fruits of the lower tray so as to partially encase such fruit and hold the same snugly against the tray supporting the fruit. With the fruit snugly held against the tray the tendency of the fruit to rotate is minimized thereby minimizing possible injury to the surface of the fruit during shipment.

DRAWINGS

Figure 1:
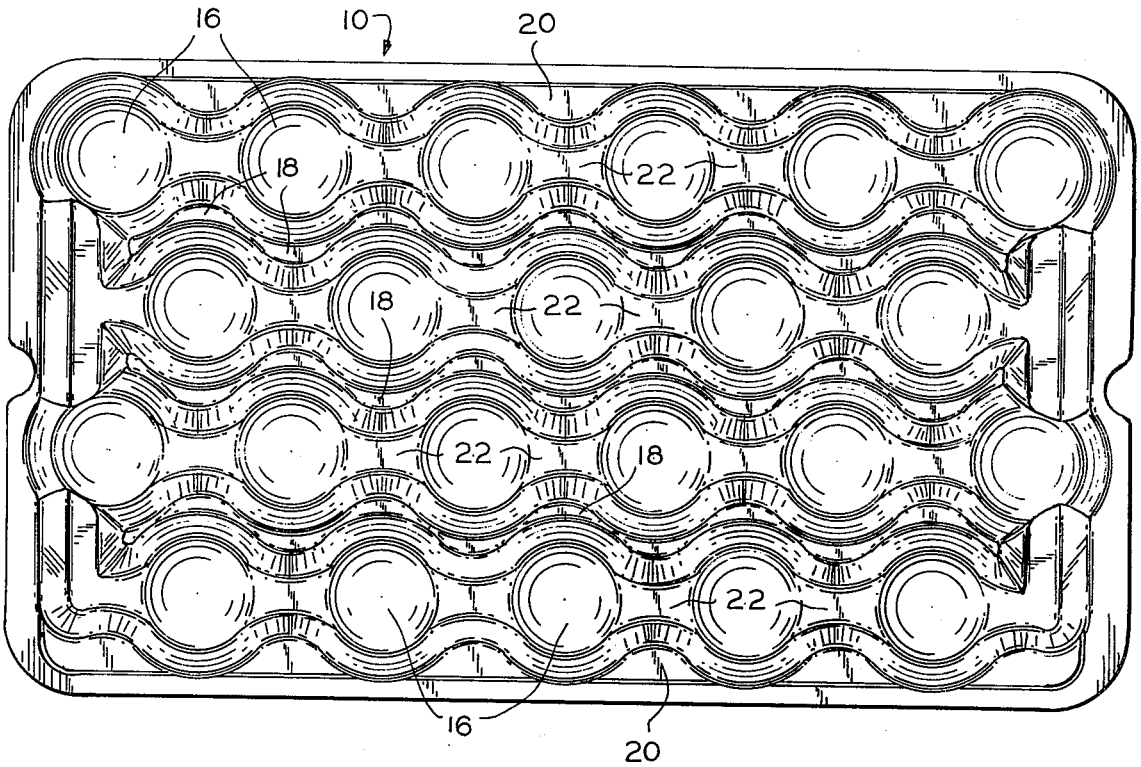
FIG. 1 is a plan view of a typical packaging tray to which the invention may be applied.

Referring now to the drawings, indicated at 10 are molded packing trays of pulp, or if desired, other suitable materials such as plastic. The trays are identical in construction and serve to carry articles such as, for example, pears 12 in layers in a lug, box or carton 14.

The tray 10 is a conventional tray and may, for example, be constructed in the manner shown in U.S. Pat. 3,040,923. Other trays may also be used as will appear evident. The illustrated tray 10 is provided with pockets 16 arranged in longitudinal and diagonal rows. The longitudinal rows are defined by sinuous ridges 18, the crests of which are in the same plane as edge portion 20 of the tray. The pockets 16 are separated from one another in the longitudinal direction by relatively large flat areas 22. The numbers of pockets in alternate transverse rows are odd and even, and the pockets are so positioned that when alternate trays are reversed end for end in a tier of trays each pocket in a lower tray is below a relatively large flat area 22 in an upper tray. The flat areas 22 are all in a common plane parallel to an intermediate of the planes of the ridges 18 and the lower extremities of the pockets 16 all of which also lie in a common plane below the plane of the flat areas 22.

Figures 2, 3:
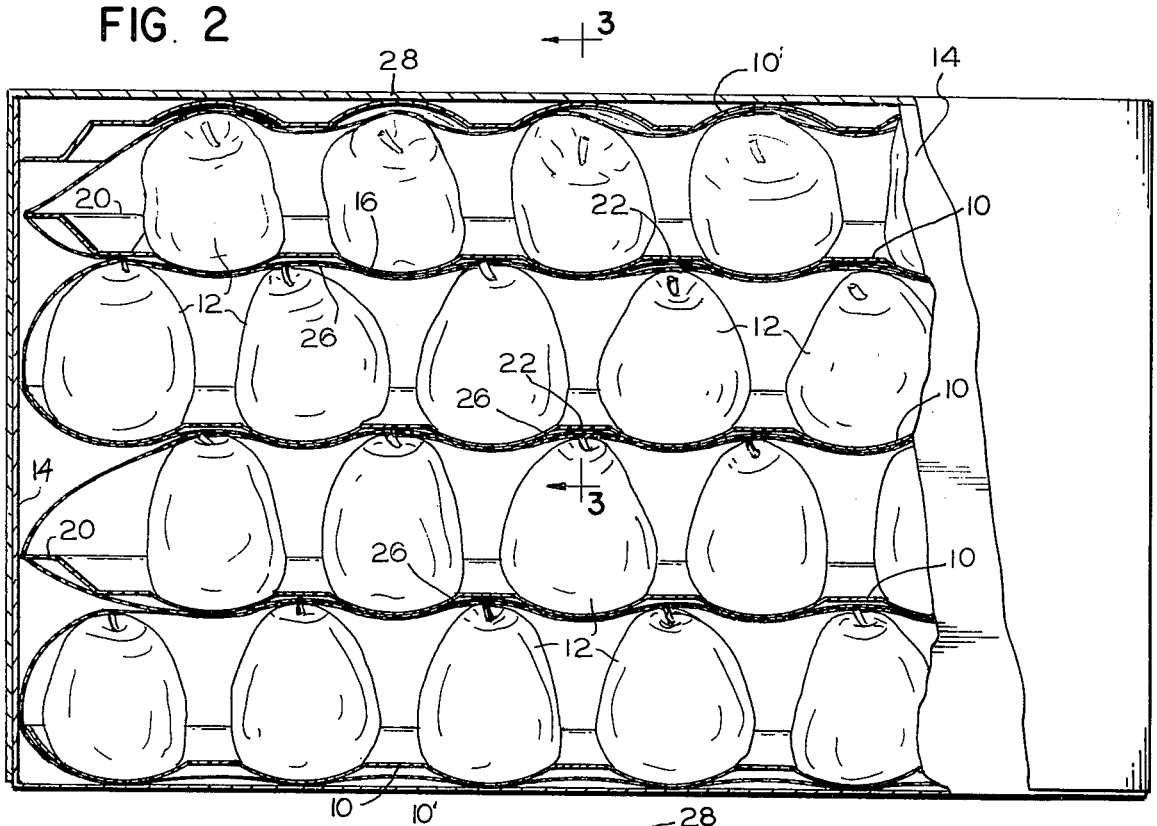
FIG. 2 is a fragmentary vertical section of a carton of pears showing the invention.
FIG. 3 is an enlarged section taken along line 3—3 of FIG. 2.

With particular reference to FIGS. 2 and 3, when loaded trays 10 are stacked, most of the individual fruits 12 will engage the central portion of the large flat areas 22 of the superposed tray. Thus the upper trays are supported by the fruit on the trays beneath and the pressure of the trays on such fruit will usually prevent their rotation. However, if the piece of fruit is undersized as compared to others on its tray it may not necessarily be engaged by the flat area 22 and thus may bounce and twist in the tray by the jiggling movement imparted to the carton 14 during shipment.

Thus, in accordance with the invention each of the trays 10 is provided with a cover 26 of flexible material which is adapted to be pressed into engagement with each of the pieces of fruit 12 on a tray by the pressure of the superposed tray to prevent each of the pieces 12 on a tray from bouncing and twisting during shipment. The cover 26 is secured to opposite edges of the tray 10, such as by cementing the same to the edges, or by providing the cover in the form of an envelope into which the tray is inserted and which envelope may be sealed at each of its opposite ends thereby, in effect, securing the cover to all four of the edges of the tray 10. The cover 26 is of a sufficient slackness or length between the opposite secured edges that the superposed tray by reason of the engagement of the bottom surface of the pockets 16 with the cover 26 between adjacent fruit pieces 12 the cover 26 will be depressed into snug engagement with each of the pieces of fruit on the tray 10, as best shown in FIG. 3.

A rough test for the proper degree of slackness of the cover 26 is that when the tray is loaded and the cover is in place, the cover can be depressed in the center of the tray to a ridge 18 by pressing with a finger. If the film is too slack it will not hold the fruit sufficiently snugly; if it is too tight a bridging action will occur so that the loaded trays will take up too much room and will not stack sufficiently well to be contained within the conventional carton 14.

A preferred film is a polyethylene shrinkable film of 0.00125 inch thickness sold by Dow Chemical Company, their film type 128. An envelope of such material may be formed and a tray of loaded apples inserted in the envelope and then the ends heat sealed with a conventional hot shoe. Thereafter the wrapper is subjected to air at a temperature of about 280° for a brief period of time, say a few seconds, in order to shrink the film so as to obtain the desired slackness. Since the shrinkage of the film is a function of time and temperature the amount of shrinkage of the film can be controlled by controlling these factors. The trays are then loaded in the conventional standard-sized shipping carton with an empty tray 10' being inverted at the very top and the cover 28 of the carton put in place. All of the fruit in the carton will then be snugly held in place.

Successful test shipments have been made with the arrangement of the invention with much less bruising or marring of the fruit than with conventional packing methods.

Preferably the film cover 26 has carbon dioxide and oxygen permeability sufficient for respiration of the fruit. If the film does not have an inherent porosity to these gases, the film may be perforated to provide a sufficient degree of porosity for this purpose.

Instead of utilizing a shrink film it will be apparent that the invention could utilize an elastic film having a sufficient degree of elasticity to permit snug nesting of the trays in their usual fashion but having gripping engagement of each fruit on a tray with the film.

Having illustrated and described a preferred embodiment of the invention, modifications and arrangement in detail will be apparent to those skilled in the art.

We claim:

1. A package comprising a carton including a bottom wall and top wall:

a plurality of trays of molded sheet material positioned in stacked relationship in said carton, each tray being formed to define a plurality of parallel rows of upwardly facing object receiving pockets and bridge portions between at least some of said pockets, and rounded objects susceptible to damage during shipment and having predetermined minimum and maximum diameters positioned in said pockets, said pockets having a depth less than the mean diameter of said objects whereby said objects project substantially above the upper surface of said tray, the surface portions of the tray beneath said pockets extending beneath said bridge portions, the pockets of each row of a said tray being staggered with respect to each next adjacent row and with respect to the pockets of each tray immediately above and below said tray whereby the pockets of a tray will project downwardly between the objects in the next lower tray, and a cover of flexible material secured only to opposite edges of each tray, said cover having sufficient length between said edges to permit the said bridge portions of a superposed tray to engage at least some of the objects on the tray immediately beneath, and to permit the pocket portions of said superposed tray to depress the said cover between each of said objects and render said cover taut and partially envelope each of the objects on said lower tray so as to snugly hold the said objects in position on said lower tray thereby to minimize damage to the said objects during shipping of the carton.

2. The package of claim 1 wherein said cover is formed of a resilient material.

3. The package of claim 1 wherein said cover is secured to four edges of a said tray.

4. The package of claim 1 wherein said objects are fruit and said cover has a permeability to gases compatible with the respiration rate of the fruit on such tray.

* * * * *